US011367562B2

(12) United States Patent
Lin

(10) Patent No.: US 11,367,562 B2
(45) Date of Patent: Jun. 21, 2022

(54) MAGNETIC DEVICE AND THE METHOD TO MAKE THE SAME

(71) Applicant: CYNTEC CO., LTD., Hsinchu (TW)

(72) Inventor: Yu-Hsin Lin, Taipei (TW)

(73) Assignee: CYNTEC CO., LTD., Hsinchu (TW)

( * ) Notice: Subject to any disclaimer, the term of this patent is extended or adjusted under 35 U.S.C. 154(b) by 595 days.

(21) Appl. No.: 16/264,693

(22) Filed: Feb. 1, 2019

(65) Prior Publication Data

US 2020/0251277 A1 Aug. 6, 2020

(51) Int. Cl.

| | |
|---|---|
| ***H01F 27/24*** | (2006.01) |
| ***H01F 27/32*** | (2006.01) |
| ***H01F 27/34*** | (2006.01) |
| ***H01F 41/12*** | (2006.01) |
| ***H01F 27/28*** | (2006.01) |

(52) U.S. Cl.

CPC ..... *H01F 27/323* (2013.01); *H01F 27/2823* (2013.01); *H01F 27/327* (2013.01); *H01F 27/34* (2013.01); *H01F 41/127* (2013.01)

(58) Field of Classification Search

USPC ..... 336/233

See application file for complete search history.

(56) References Cited

U.S. PATENT DOCUMENTS

| | | | | |
|---|---|---|---|---|
| 2002/0067232 | A1* | 6/2002 | Oshima | H01F 41/122 336/96 |
| 2016/0133377 | A1* | 5/2016 | Takagi | H01F 41/066 336/192 |
| 2018/0204657 | A1* | 7/2018 | Shinkai | C22C 45/02 |

* cited by examiner

*Primary Examiner* — Ronald Hinson

(74) *Attorney, Agent, or Firm* — Litron Patent & Trademark Office; Min-Lee Teng

(57) ABSTRACT

A coating layer is used to encapsulate winding turns of an insulated conductive wire of a coil that is encapsulated by a magnetic material containing magnetic particles so as to prevent the magnetic particles from damaging the insulated insulating layer of the insulated conductive wire of the coil when the magnetic material is pressed to form a magnetic body, thereby avoiding unwanted short circuits that are caused by the magnetic particles and damaged portions of the insulated conductive wire.

10 Claims, 8 Drawing Sheets

MAGNETIC DEVICE AND THE METHOD TO MAKE THE SAME

BACKGROUND OF THE INVENTION

I. Field of the Invention

The present invention relates to a magnetic device, and in particular, to a magnetic device having a coil made by an insulated conductive wire.

II. Description of Related Art

Conventional electronic components, such as inductors and chokes, are often prepared by high-pressure molding of a coil and a magnetic powder so as to form a magnetic body encapsulating the coil. In the high-pressure molding process, particles of the magnetic powder penetrate into the insulation layer of the conductive wire of the coil, rendering the coil unable to sustain higher pressure or interlayer short circuits. However, if a lower pressure is used during the molding process, the density of the magnetic body will be reduced and the inductance of the inductor or choke will drop off as well. If the thickness of the insulating layer of the coil is increased, it will be difficult to wind the conductive wire like a coil and the size of the coil size will also be too large, resulting in a lowered inductance.

Therefore, a better solution is needed to resolve the above-mentioned issues.

SUMMARY OF THE INVENTION

One objective of the present invention is to add a coating layer to encapsulate a coil to prevent particles of at least one magnetic powder from penetrating into the insulating layer of the conductive wire of the coil during a molding process so as to avoid short circuits of the coil.

One objective of the present invention is to add a coating layer to encapsulate a coil for preventing the self-adhesive layer flowing out during a molding process to form a molding body encapsulating the coil.

One objective of the present invention is to add a coating layer to encapsulate a coil to increase the degree of the insulation between the coil and the magnetic body so as to allow the coated coil to sustain higher voltages.

The present invention provides a coating layer to encapsulate the insulated conductive wire of the coil disposed in a magnetic body comprising at least one magnetic powder to prevent particles of the at least one magnetic powder from damaging the insulated insulating layer of the insulated conductive wire of the coil so as to avoid unwanted short circuits between different portions of the coil.

In one embodiment of the present invention, a magnetic device is disclosed, wherein the magnetic device comprises: a coil, comprising a plurality of winding turns of an insulated conductive wire, wherein the insulated conductive wire comprises a conductive metal wire and at least one first insulating layer encapsulating the conductive metal wire, wherein at least two different portions of the coil form a first space therebetween; a coating layer, comprising an insulating material to encapsulate said at least two different portions of the coil and fills into said first space; and a magnetic body, wherein the magnetic body comprises at least one magnetic powder and an adhesive material to mix particles of the at least one magnetic powder, wherein the magnetic body encapsulates the plurality of winding turns of the insulated conductive wire and the coating layer.

In one embodiment, the magnetic body has a unitary body that encapsulates the plurality of winding turns of the insulated conductive wire and the coating layer and extends into the hollow space of the coil.

In one embodiment, two different portions of adjacent outer winding turns of the insulated conductive wire form the first space therebetween, wherein the coating layer encapsulates said two different portions of adjacent outer winding turns of the insulated conductive and extends into said first space.

In one embodiment, a portion of a winding turn of the insulated conductive wire and a portion of a terminal part of the insulated conductive wire forms the first space therebetween, wherein the coating layer encapsulates said portion of the winding turn of the insulated conductive wire and said first portion of the terminal part of the insulated conductive wire and extends into said first space.

In one embodiment, the entire outer surface of the plurality of winding turns of an insulated conductive wire is encapsulated by the coating layer.

In one embodiment, the magnetic device is an inductor.

In one embodiment, the at least one first insulating layer comprises only one insulating layer.

In one embodiment, the at least one first insulating layer comprises two insulating layers, wherein said two insulating layers are made of different insulating materials.

In one embodiment, the coating layer comprises a polymer material.

In one embodiment, the coating layer comprises a resin.

In one embodiment, the coating layer comprises an organic material.

In one embodiment, the magnetic body comprises only one magnetic powder.

In one embodiment, the magnetic body comprises a first magnetic powder and a second magnetic powder, wherein the first magnetic powder and the second magnetic powder are mixed with the adhesive material.

In one embodiment of the present invention, a method for forming a magnetic device is disclosed, wherein the method comprises: providing a coil comprising a plurality of winding turns of an insulated conductive wire, wherein the insulated conductive wire comprises a conductive metal wire and at least one first insulating layer encapsulating the conductive metal wire, wherein at least two different portions of the insulated conductive wire form a first space therebetween; forming a coating layer comprising an insulating material to encapsulate said at least two different portions of the insulated conductive wire, said insulating material being filled into said first space; and forming a magnetic body to encapsulate the plurality of winding turns of the insulated conductive wire and the coating layer, wherein the magnetic body comprises at least one magnetic powder and an adhesive material to mix particles of the at least one magnetic powder, so as to prevent particles of the magnetic powder from damaging the corresponding portions of the at least one first insulating layer of the at least two different portions of the coil.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

For the following description, the terms D10, D50 and D90 are used for describing the particle size distribution of magnetic powders. D10 means 10% of the total number of the particles is less than the D10, D50 means 50% of the total number of the particles is less than D50 and D90 means 90% of the total number of the particles is less than D90.

Figure 1:
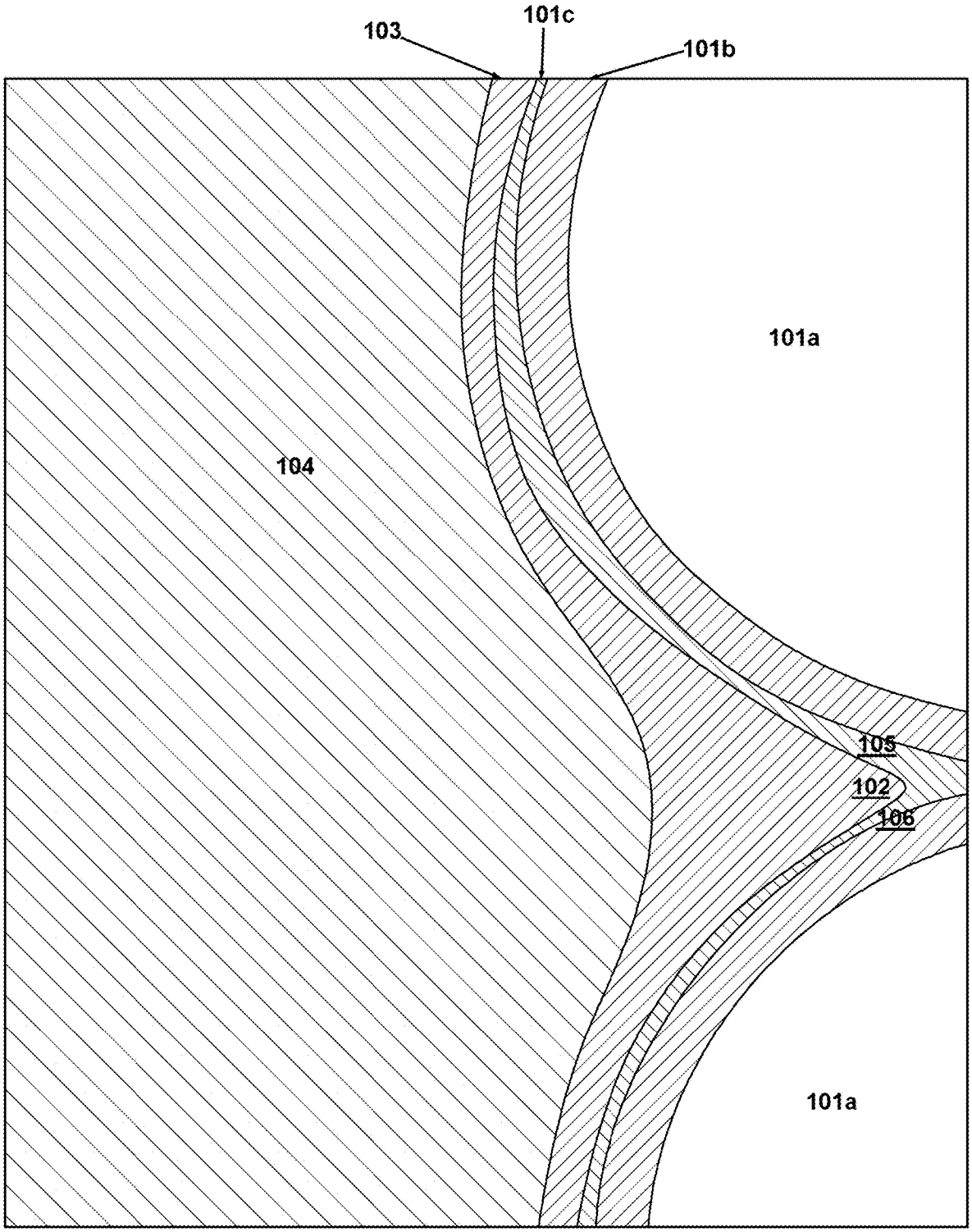
FIG. 1 is an enlarged cross-sectional view illustrating a magnetic device having a coil and a coating layer encapsulating two different portions of the coil of the magnetic device according to one embodiment of the present invention.

FIG. 1 depicts an enlarged cross-sectional view of a magnetic device, wherein the magnetic device comprises a coil which comprises a plurality of winding turns of an insulated conductive wire, wherein the insulated conductive wire comprises a conductive metal wire 101*a* and at least one first insulating layer 101*b* that encapsulates the conductive metal wire 101*a*, wherein at least two different portions of the insulated conductive wire form a first space 102 therebetween; a coating layer 103 made of a first insulating material that encapsulates the at least two different portions 105, 106 of the coil and fills into the first space 102; and a magnetic body 104, wherein the magnetic body 104 comprise at least one magnetic powder and an adhesive material to mix particles of the at least one magnetic powder, wherein the plurality of winding turns of the insulated conductive wire and the coating layer 103 are encapsulated by the magnetic body 104 so as to prevent at least one particle of the magnetic powder from damaging the corresponding portions of the at least one first insulating layer of the at least two different portions of the coil so as to avoid a short circuit between said two different portions of the insulated conductive wire via at least one particle of the magnetic powder.

As shown in FIG. 1, the coating layer 103 encapsulates the coil so that particles of the at least one magnetic powder will not cause a short circuit between different portions of the coil when the magnetic body 104 is being formed under a pressure. If the coating layer 103 is not present in the magnetic device, at least one particle of the at least one magnetic powder can be disposed in said first space when the magnetic body 104 is being formed under a pressure, and the at least one particle of the at least one magnetic powder can damage the at least one first insulating layer of the conductive metal wire and cause a short circuit between said at least two different portions of the coil.

In one embodiment, the insulated conductive wire has only one insulating layer: the first insulating layer 101*b*.

In one embodiment, the insulated conductive wire has only two insulating layers: the first insulating layer 101*b* and a second insulating layer 101*c*.

In one embodiment, the second insulating layer 101*c* can be a self-adhesive layer, wherein the coating layer coated 103 on the self-adhesive layer can prevent the self-adhesive layer flowing out during a molding process. Furthermore, the coating layer 103 coated on the self-adhesive layer can further electrically isolate the coil from particles of the at least one magnetic powder to avoid a short circuit caused by particles of the at least one magnetic powder. In one embodiment, the insulated conductive wire can be an enameled wire, wherein the enameled wire can have a circular shape. In one embodiment, the conductive metal wire of the enameled wire comprises copper.

Figure 2A:
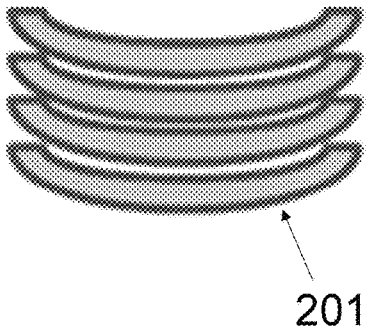
FIGS. 2A-2B illustrate a cross-sectional view before and after a coating layer is added to encapsulate two different portions of the coil of the magnetic device according to another embodiment of the present invention.
Figure 2B:
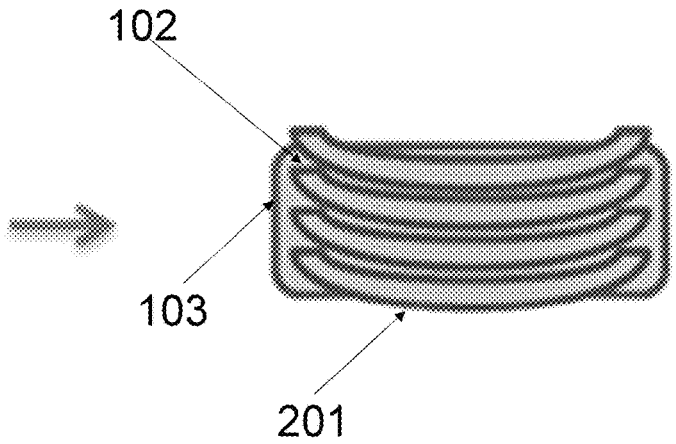

FIG. 2A shows a coil 201 before a coating layer is added while FIG. 2B shows the coil 201 after the coating layer 103 is added. As shown in FIG. 2B, in one embodiment, two adjacent winding turns of the insulated conductive forms the first space 102 therebetween, wherein the insulating material of the coating layer 103 is filled into the first space 102.

Figure 2C:
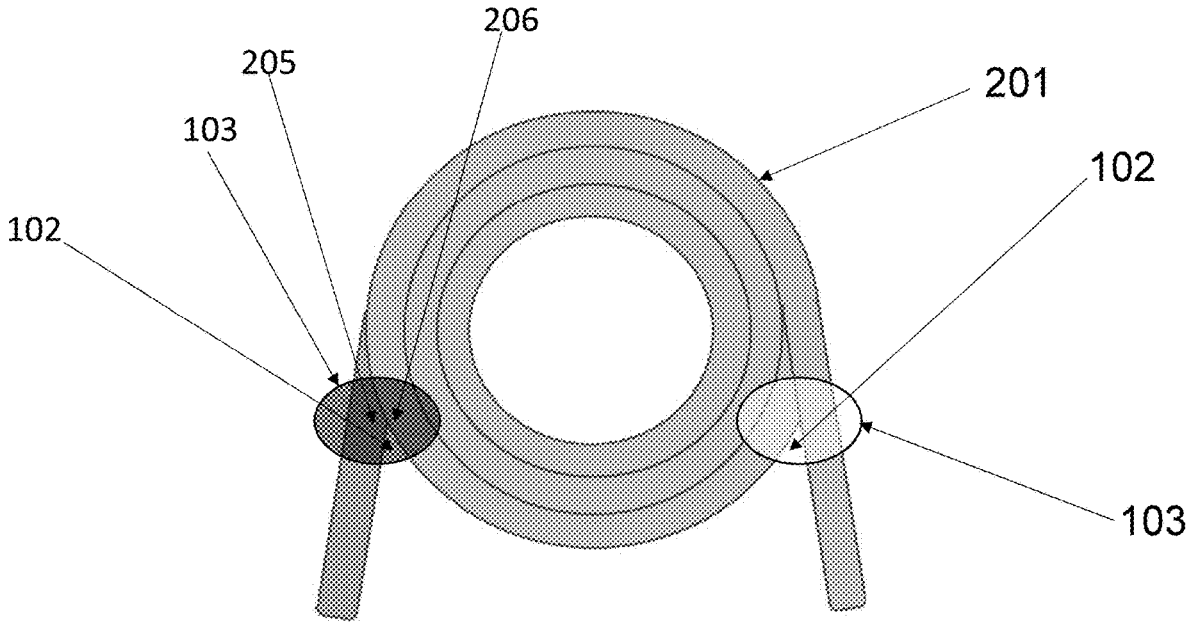
FIG. 2C is a cross-sectional view illustrating a coating layer to encapsulate at least two different portions of the coil of the magnetic device according to another embodiment of the present invention.

FIG. 2C shows a coil 201, wherein a portion of a winding turn of the insulated conductive wire 205 and a first portion of a terminal part 206 of the insulated conductive wire forms the first space 102 therebetween, wherein the first insulating material of the coating layer 103 filled into the first space 102 for preventing at least one particle of the at least one magnetic powder from being disposed in said first space 102.

Figure 2D:
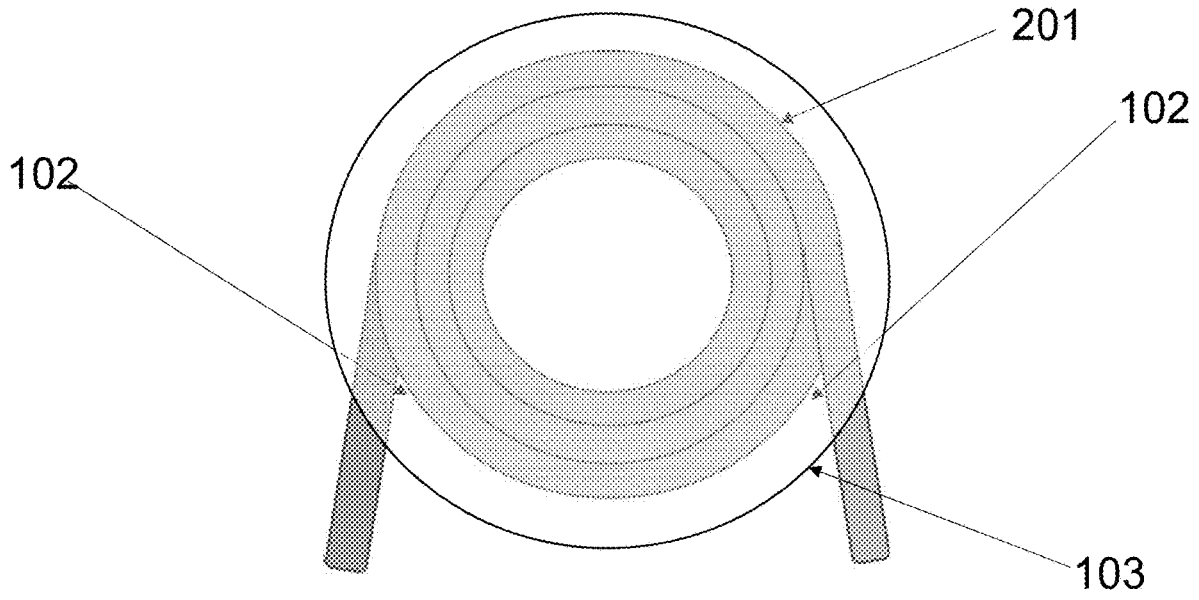
FIG. 2D is a cross-sectional view illustrating a coating layer to encapsulate the entire outer surface of the plurality of winding turns of the coil according to another embodiment of the present invention.

In one embodiment, as shown in FIG. 2D, the entire outer surface of the plurality of winding turns of the coil 201 is encapsulated by the coating layer 103.

In one embodiment, the entire outer surface and the entire inner surface of the plurality of winding turns of the coil 201 are encapsulated by the coating layer 103.

In one embodiment, a portion of a winding turn of the insulated conductive wire and a lead that is electrically connected to a terminal part of the insulated conductive wire of the coil forms a second space therebetween, wherein the coating layer encapsulates said portion of a winding turn of the insulated conductive wire and at least one portion of the lead and extends into said second space.

In one embodiment, the insulated conductive wire has only one insulating layer: the first insulating layer 101*b*.

Please note that the coating layer 103 can encapsulate just the portions of the coil that are easily shorted by the particles of the at least one magnetic powder. That is, it is not necessary to coat the entire outer surface of the coil 201, as shown in FIG. 2C.

In one embodiment, the at least one first insulating layer comprises two insulating layers, wherein said two insulating layers are made of different insulating materials.

In one embodiment, the magnetic device is an inductor.

In one embodiment, the coating layer comprises a polymer material.

In one embodiment, the coating layer comprises a resin.

In one embodiment, the coating layer comprises an organic material.

In one embodiment, the magnetic body comprises a first magnetic powder and a second magnetic powder, wherein the first magnetic powder and the second magnetic powder are mixed with an adhesive material.

In one embodiment, wherein the D50 of the first magnetic powder is in the range of 8 to 36 um while the D50 of the second magnetic powder is in the range of 1.0 to 10 um, the D10 of the first magnetic powder is in the range of 3 to 20 um while the D10 of the second magnetic powder is in the range of 0.5 to 6 um, and the D90 of the first magnetic powder is in the range of 20 to 60 um while the D90 of the second magnetic powder is in the range of 2 to 12 um.

In one embodiment, the magnetic body comprises a first magnetic powder, wherein D50 of the first magnetic powder is in the range of 17 to 36 um, the D10 of the first magnetic powder is in the range of 8 to 26 um, and the D90 of the first magnetic powder is in the range of 30 to 52.

In one embodiment, the magnetic body comprises a first magnetic powder, wherein D50 of the first magnetic powder is in the range of 8 to 16 um, the D10 of the first magnetic powder is in the range of 3 to 6 um, and the D90 of the first magnetic powder is in the range of 18 to 30.

Figure 3:
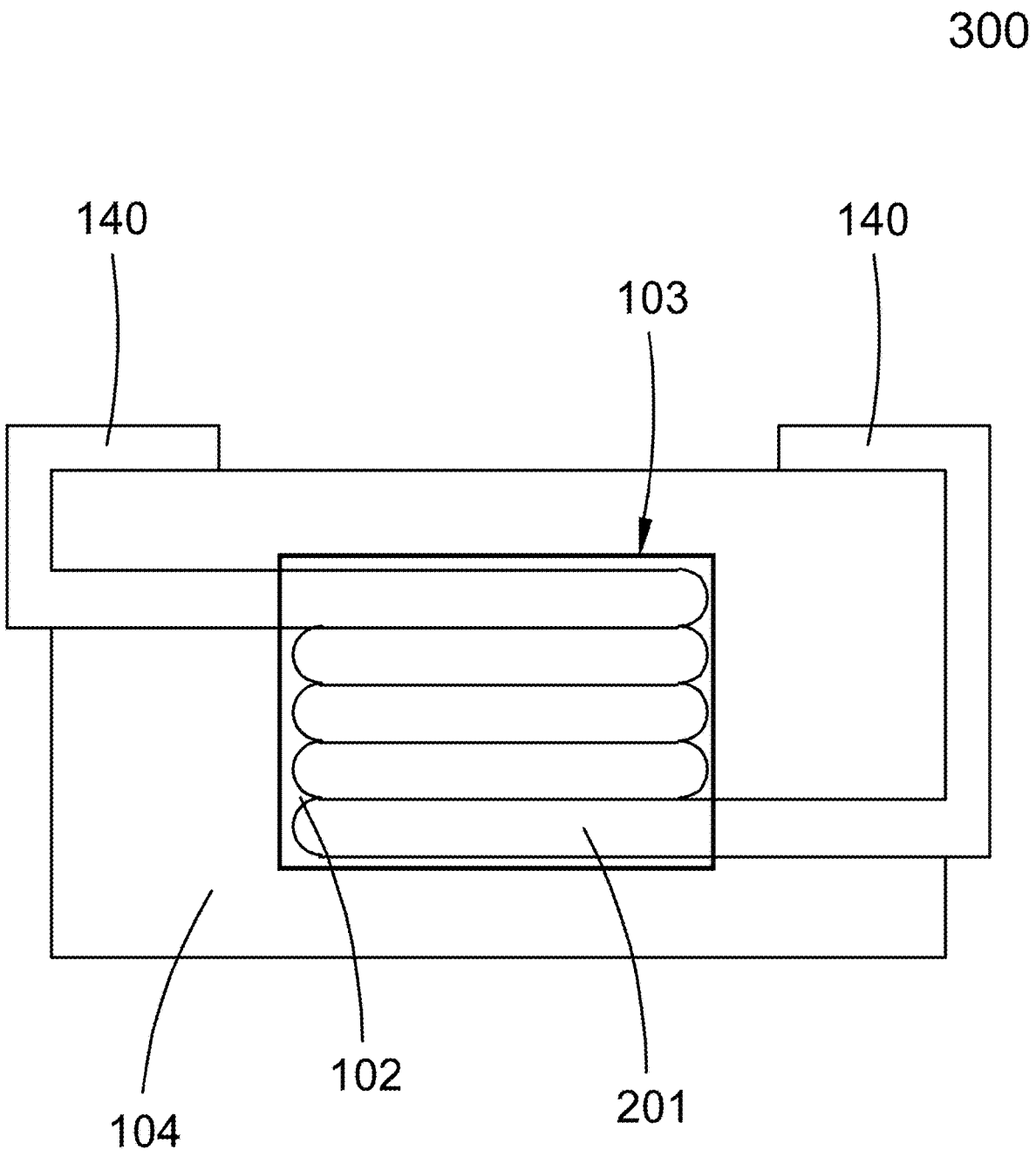
FIG. 3 depicts a magnetic device according to one embodiment of the present invention.

FIG. 3 depicts a magnetic device according to one embodiment of the present invention, wherein the magnetic device comprises: a coil 201, comprising a plurality of winding turns of an insulated conductive wire, wherein the insulated conductive wire comprises a conductive metal wire and at least one first insulating layer encapsulating the conductive metal wire, the insulated conductive wire can be in a suitable shape, such as a round wire, wherein at least two different portions of the coil 201 form a first space 102 therebetween; a coating layer 103 encapsulates said at least two different portions of the coil 201 and extends into said first space 102; and a magnetic body 104, formed by at least one magnetic powder and an adhesive material mixed with particles of the at least one magnetic powder, wherein the magnetic body 104 encapsulates the plurality of winding turns of the insulated conductive wire of the coil 201.

In one embodiment, the magnetic body 104 encapsulates the plurality of winding turns of the insulated conductive wire of the coil 201 and extends into the hollow space of the coil 201.

In one embodiment, the coating layer 103 extends into a hollow space of the coil 201 to encapsulate the inner surface of the coil.

In one embodiment, a lead 140 is disposed on the magnetic body 104 and electrically connected to the coil 201.

As shown in FIG. 3, the coating layer 103 encapsulates the coil so that particles of the at least one magnetic powder will not cause a short circuit between different portions of the coil 201 when the magnetic body 104 is being formed under a pressure. If the coating layer 103 is not present in the magnetic device, at least one particle of the at least one magnetic powder can be disposed in said first space when the magnetic body 104 is being formed under a pressure, and the at least one particle of the at least one magnetic powder can damage the at least one first insulating layer of the conductive metal wire and cause a short circuit between said at least two different portions of the coil 201.

Figure 4:
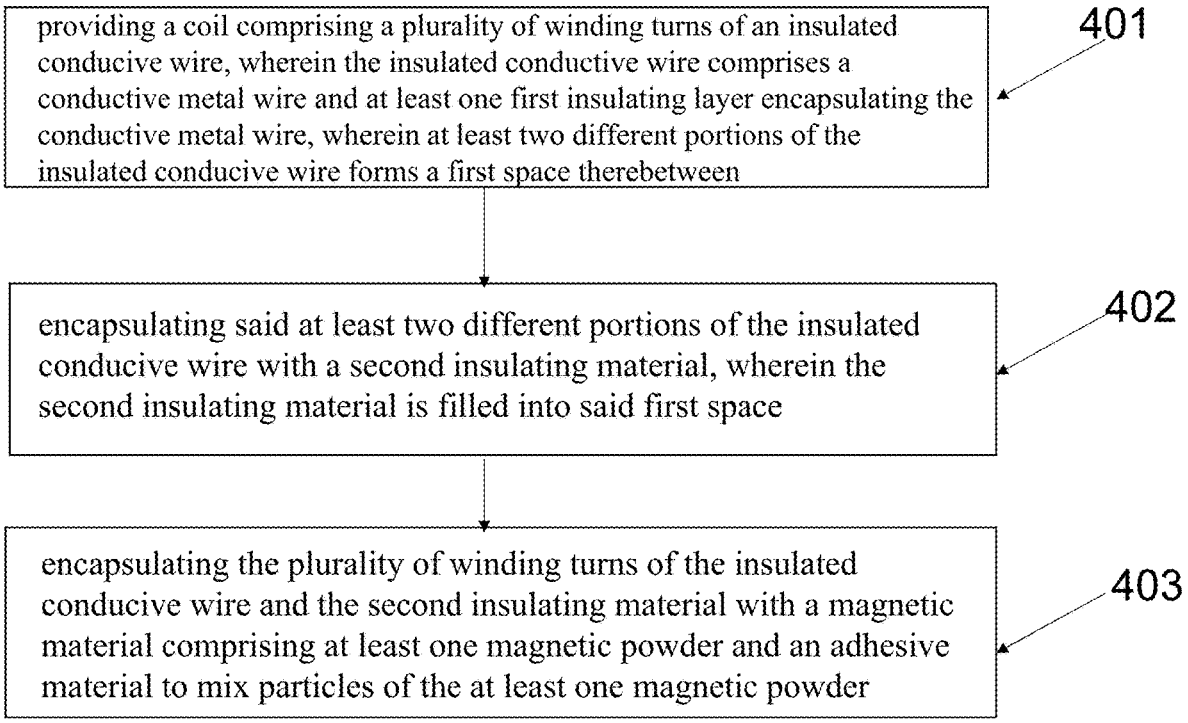
FIG. 4 depicts a flow chart of a method for forming a magnetic device.

FIG. 4 depicts a flow chart of a method for forming a magnetic device, the method comprising: in step 401: providing a coil comprising a plurality of winding turns of an insulated conductive wire, wherein the insulated conductive wire comprises a conductive metal wire and at least one first insulating layer encapsulating the conductive metal wire, wherein at least two different portions of the insulated conductive wire forms a first space therebetween; in step 402: encapsulating said at least two different portions of the insulated conductive wire with a second insulating material, wherein the second insulating material is filled into said first space; and in step 403: encapsulating the plurality of winding turns of the insulated conductive wire and the second insulating material with a magnetic material comprising at least one magnetic powder and an adhesive material to mix particles of the at least one magnetic powder, so as to prevent particles of the magnetic powder from damaging the corresponding portions of the at least one first insulating layer of the at least two different portions of the coil.

In one embodiment, two adjacent winding turns of the insulated conductive forms the first space 102 therebetween, wherein the first insulating material of the coating layer 103 is filled into the first space 102 for preventing at least one particle of the at least one magnetic powder from being disposed in said first space, since the at least one particle of the at least one magnetic powder may penetrate into the at least one first insulating layer and cause a short circuit between said two different portions of the insulated conductive wire.

There are many ways to encapsulate the at least two different portions of the insulated conductive wire with the second insulating material, for example, by dipping an insulating material on the wound insulated wire or spraying an insulating material on the wound insulated wire or soaking the wound insulated wire in an insulating material or dispensing glue on the wound insulated wire or pouring glue on the wound insulated wire so that an outer surface of the coil can be encapsulated by the insulating material for preventing particles of the magnetic powder from penetrating the at least one insulating layer of the wound insulated wire.

Figure 5:
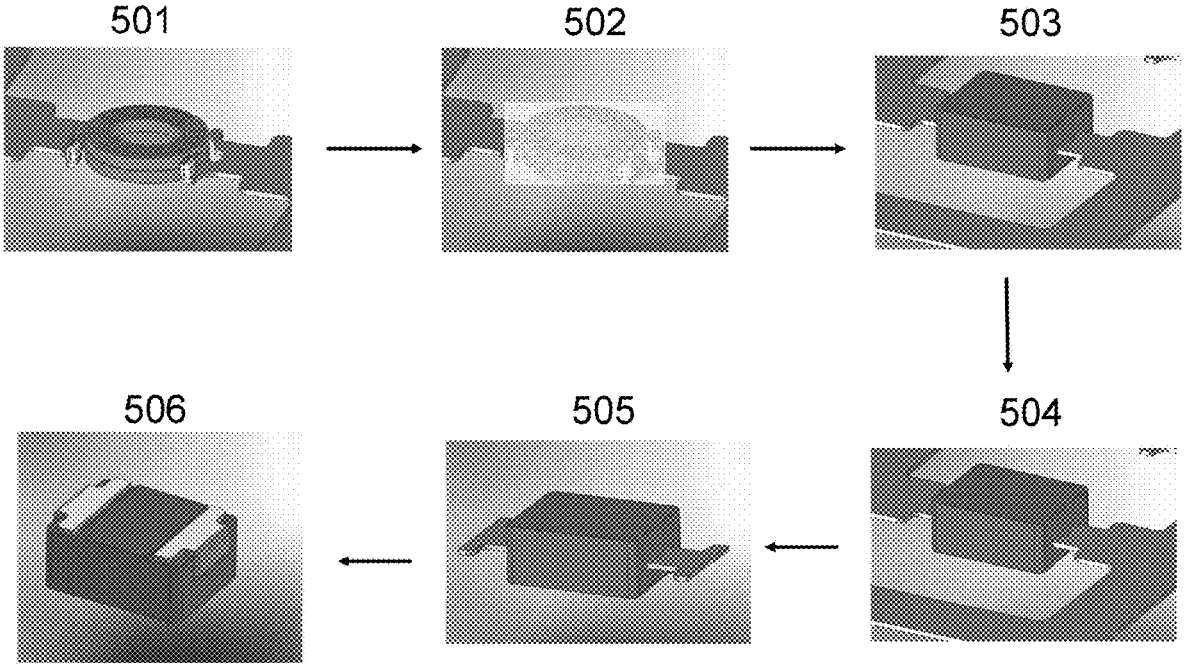
FIG. 5 illustrates a method for forming an inductor according to one embodiment of the present invention.

FIG. 5 illustrates a method for forming an inductor according to one embodiment of the present invention. As shown in FIG. 5, the method comprises: in step 501: providing a coil comprising a plurality of winding turns of an insulated conductive wire, wherein the insulated conductive wire comprises a conductive metal wire and at least one first insulating layer encapsulating the conductive metal wire, wherein two terminals of the coil are electrically connected with a lead frame; in step 502: forming a coating layer to encapsulate at least one portion of the plurality of winding turns of the insulated conductive, wherein the coating layer comprises a second insulating material that is filled into a first space formed by different portions of the coil; in step 503: forming a molding body to encapsulate the plurality of winding turns of the insulated conductive wire and the coating layer, wherein the molding body comprises at least one magnetic powder and an adhesive material to mix particles of the at least one magnetic powder; in step 504: performing a hot pressing to cure the molding body; and in step 505: trimming the lead frame to remove unwanted portions of the lead frame; and in step 506: forming two leads on a bottom surface of the molding body so as to form the inductor.

Figure 6:
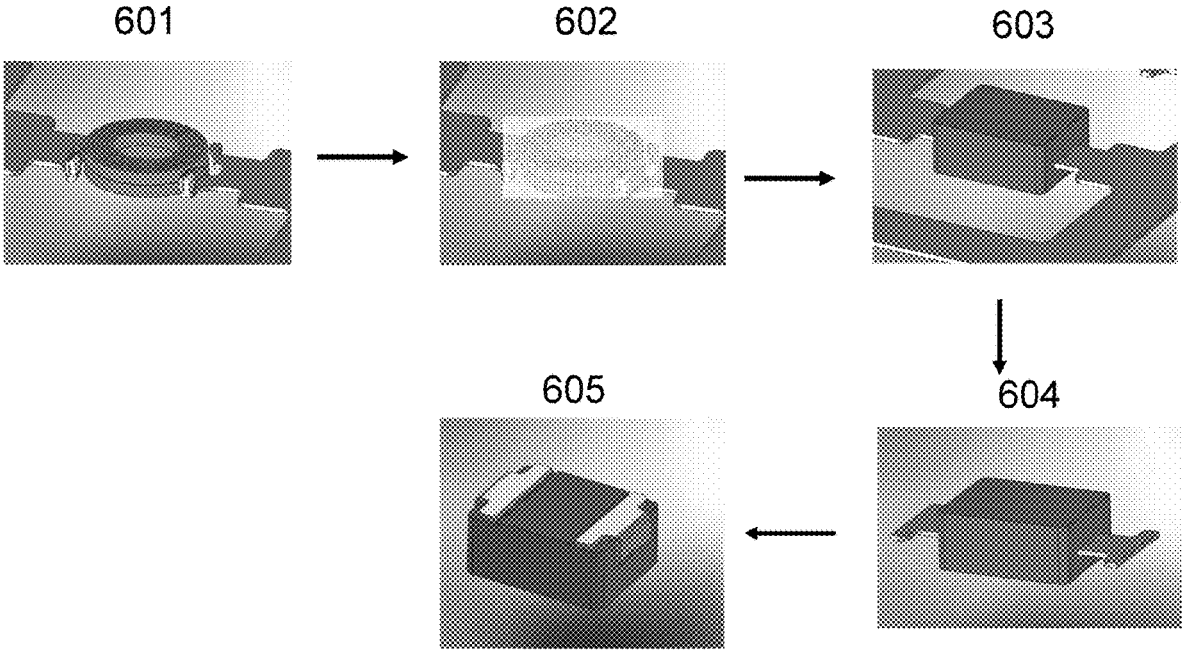
FIG. 6 illustrates a method for forming an inductor according to another embodiment of the present invention.

FIG. 6 illustrates a method for forming an inductor according to one embodiment of the present invention. As shown in FIG. 6, the method comprises: in step 601: providing a coil comprising a plurality of winding turns of an insulated conductive wire, wherein the insulated conductive wire comprises a conductive metal wire and at least one first insulating layer encapsulating the conductive metal wire, wherein two terminals of the coil are electrically connected with a lead frame; in step 602: forming a coating layer to encapsulate at least one portion of the plurality of winding turns of the insulated conductive, wherein the coating layer comprising a second insulating material that is filled into a first space formed by different portions of the coil; in step 603: forming a molding body to encapsulate the plurality of winding turns of the insulated conductive wire and the coating layer, wherein the molding body comprises at least one magnetic powder and an adhesive material to mix particles of the at least one magnetic powder, wherein the molding body is cured without using a hot processing; in step 604: trimming the lead frame to remove unwanted portions of the lead frame; and in step 605: forming two leads on a bottom surface of the molding body so as to form the inductor.

The present invention has many advantages: (1) the coating layer can prevent particles of the magnetic powder that are used to form a magnetic body of the magnetic device from penetrating into the insulating layer of the insulated conductive wire of the coil so that the coil can sustain higher pressure without producing short circuits of the coil when the magnetic powder is pressed to form the magnetic body; (2) the coating layer can prevent the flow of the self-adhesive layer of the insulated conductive during the molding process to form the magnetic body; (3) increase the degree of insulation between the coil and the magnetic powder; (4) enabling the coated coil to sustain higher voltage.

Although the present invention has been described with reference to the above embodiments, it will be apparent to one of ordinary skill in the art that modifications to the described embodiment may be made without departing from the spirit of the invention. Accordingly, the scope of the invention will be defined by the attached claims, not by the above-detailed descriptions.

What is claimed is:

1. A magnetic device, comprising:

a coil, comprising a plurality of winding turns of an insulated conductive wire, wherein the insulated conductive wire comprises a conductive metal wire and at least one first insulating layer encapsulating the conductive metal wire, wherein at least two different portions of the plurality of winding turns of the insulated conductive wire form a first space therebetween;

a coating layer, comprising an insulating material to encapsulate said at least two different portions of the plurality of winding turns of the insulated conductive wire and fills into said first space, wherein the coating layer comprises a first continuous portion that is located outside a corresponding outermost surface of each of said at least two different portions of the plurality of winding turns of the insulated conductive wire and extends vertically across said at least two different portions of the plurality of winding turns of the insulated conductive wire and said first space that is filled by a second continuous portion that is extended from said first continuous portion of the coating layer; and a magnetic body, comprising at least one magnetic powder, wherein the magnetic body encapsulates the plurality of winding turns of the insulated conductive wire and the coating layer.

2. The magnetic device according to claim 1, wherein the magnetic body has a unitary body that encapsulates the plurality of winding turns of the insulated conductive wire and the coating layer, said unitary body extending into the hollow space of the coil.

3. The magnetic device according to claim 1, wherein the entire outer surface of the plurality of winding turns of the insulated conductive wire is encapsulated by the coating layer.

4. The magnetic device according to claim 1, wherein the magnetic device is an inductor.

5. The magnetic device according to claim 1, wherein the insulated conductive wire has only one insulating layer: the first insulating layer.

6. The magnetic device according to claim 1, wherein the insulated conductive wire has only two insulating layers: the first insulating layer and a self-adhesive layer encapsulating the first insulating layer.

7. The magnetic device according to claim 1, wherein the coating layer comprises a polymer material.

8. The magnetic device according to claim 1, wherein the coating layer comprises a resin.

9. The magnetic device according to claim 1, wherein the magnetic body comprises a first magnetic powder, wherein D50 of the first magnetic powder is in the range of 17 to 36 um, the D10 of the first magnetic powder is in the range of 8 to 26 um, and the D90 of the first magnetic powder is in the range of 30 to 52.

10. The magnetic device according to claim 1, wherein the magnetic body comprises a first magnetic powder, wherein D50 of the first magnetic powder is in the range of 8 to 16 um, the D10 of the first magnetic powder is in the range of 3 to 6 um, and the D90 of the first magnetic powder is in the range of 18 to 30.

* * * * *